United States Patent [19]

Metzger et al.

[11] Patent Number: 4,592,846

[45] Date of Patent: Jun. 3, 1986

[54] METHOD AND RESERVOIR FOR IN-GROUND CONTAINMENT OF LIQUID WASTE

[75] Inventors: Donald D. Metzger, Alma; Jeffrey E. Merriman, Mt. Pleasant, both of Mich.

[73] Assignee: PPG Industries, Inc., Pittsburgh, Pa.

[21] Appl. No.: 771,961

[22] Filed: Sep. 3, 1985

[51] Int. Cl.[4] ..... E02D 19/18; E02D 19/20

[52] U.S. Cl. ..... 210/747; 210/170; 210/901; 405/50; 405/129

[58] Field of Search ..... 210/170, 747, 901, 416.1; 137/236; 405/36, 38, 41, 43, 50, 128, 129

[56] References Cited

U.S. PATENT DOCUMENTS

| | | | |
|---|---|---|---|
| 2,211,958 | 8/1940 | Mahaffey | 137/236 |
| 3,705,851 | 12/1972 | Brauer | 210/170 |
| 4,194,855 | 3/1980 | Egger | 210/901 |
| 4,252,462 | 2/1981 | Klingle et al. | 210/170 |
| 4,296,884 | 10/1981 | Luebke | 210/170 |
| 4,335,978 | 6/1982 | Mutch | 210/901 |
| 4,366,846 | 1/1983 | Curati, Jr. | 210/747 |
| 4,388,357 | 6/1983 | Luebke | 210/170 |
| 4,473,477 | 9/1984 | Beall | 210/747 |
| 4,543,013 | 9/1985 | Wagner et al. | 210/170 |

FOREIGN PATENT DOCUMENTS

| | | | |
|---|---|---|---|
| 2430371 | 1/1976 | Fed. Rep. of Germany | 405/128 |

*Primary Examiner*—Benoit Castel
*Assistant Examiner*—Linda S. Evans
*Attorney, Agent, or Firm*—Irwin M. Stein

[57] ABSTRACT

A method for the containment of liquid-containing waste materials, such as drilling residues, in an earthen reservoir is described. The method comprises providing an in-ground reservoir opening upwardly to the surface of the ground and a sloping in-ground drainage area abutting one side of the reservoir, the bottom of the drain area being below the level to which the reservoir is filled. The reservoir and drainage area are lined with flexible liquid-impervious liners having extended sides. The extended sides of the reservoir lining are drawn, in part, over waste material in the reservoir leaving a center area of waste material uncovered with overlapped reservoir liner. The drainage area is filled with ballast material to provide a porous bed and is provided at its low end with a stand-pipe which extends from near the bottom of the drainage area to above the surface of the ground. Additionally, ballast material is placed on top of the extended side of the reservoir liner adjacent to the drainage area, thereby providing a liquid passageway from the reservoir to the drainage area. The reservoir and drainage area are covered with a flexible liquid-impervious liner cap and the space above the reservoir and drainage area filled with soil to the final grade of the surrounding terrain.

11 Claims, 1 Drawing Figure

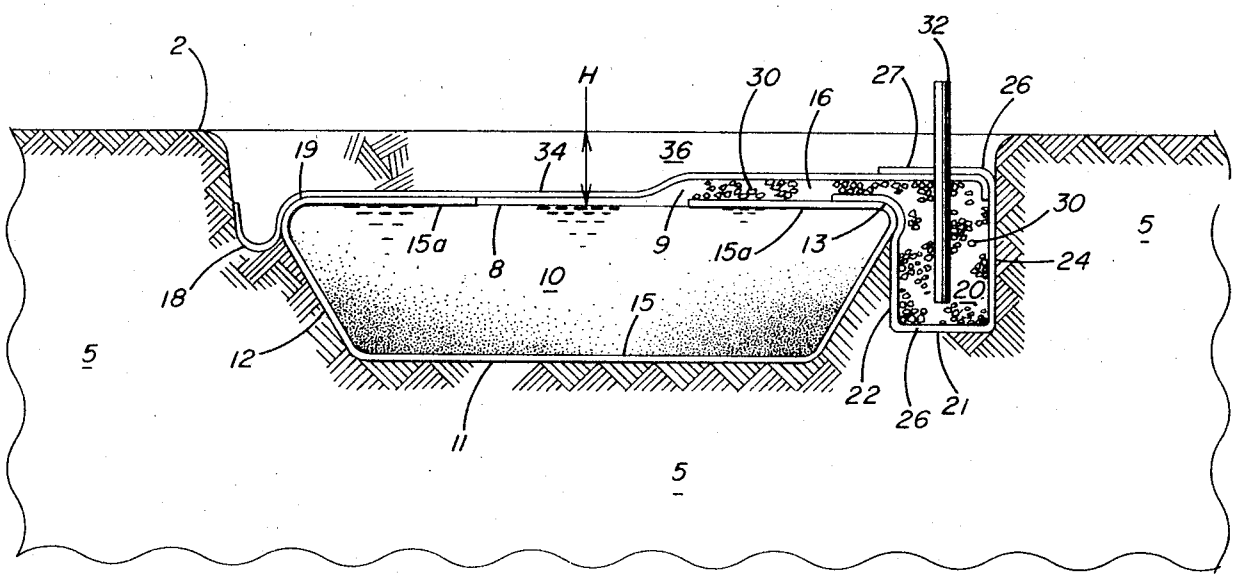
5
30
24
26
20
21
32
26
27
22
16
13
30
15a
36
9
15
5
H
34
10
8
11
15a
19
12
2
18
5

METHOD AND RESERVOIR FOR IN-GROUND CONTAINMENT OF LIQUID WASTE

DESCRIPTION OF THE INVENTION

The present invention relates to reservoirs for the containment of liquid-containing waste materials and, particularly, relates to the containment of drill cuttings, drilling mud residues, brine and other fluids produced during development of petroleum or brine wells. Typically, such fluids are deposited in an earthen containment space or pit having a liner and the space above the pit backfilled with soil to conform with the surrounding terrain. However, the weight of the backfill can force fluid from the containment pit into the soil surrounding the pit, which fluid may result in polluting surface or ground water.

The present invention is directed to a containment reservoir and a method of forming the same which minimizes the possibility of ground and/or water pollution by fluids expelled from an earthen pit as a consequence of backfilling the pit with soil. The reservoir of the present invention includes a drain area for fluid waste material exuded from the reservoir, a liquid passageway from the reservoir to the drain area and means for accessing fluid accumulating in the drain area.

The objects and advantages of the containment reservoir of the present invention will become more apparent from the following description taken in conjunction with the accompanying drawing.

BRIEF DESCRIPTION OF THE DRAWING

The drawing accompanying the description is a fragmentary vertical transverse view of a lined earthen reservoir with an adjacent drainage area.

DETAILED DESCRIPTION OF THE INVENTION

Referring now to the accompanying figure, there is illustrated an earthen containment reservoir 10 situated in undisturbed soil 5 having a surface terrain 2. Reservoir 10 is defined by a generally flat bottom 11 and sidewalls 12 which generally define the entire containment space or reservoir. Typically, the sidewalls form an angle of from about 30° to 60° with the vertical. The reservoir is disposed 15 to 18 feet (4.6 to 5.5 meters) below ground with the top of the reservoir, i.e., the height within the reservoir to which the liquid-containing waste is filled, being below surface 2 of the ground a distance H. This distance H is typically between about 3 feet (about 0.9 meter) and about 6 feet (about 1.8 meters) and generally depends upon governmental regulations controlling the construction and use of such containment reservoirs. The reservoir, as shown, is generally bowl-shaped with outwardly sloping sides; but, the reservoir can take any suitable geometric form.

A flexible, liquid-impervious liner 15 having extended ends or sides **15*a* is installed along the bottom and defining walls of earthen reservoir 10. Liner 15 generally follows the contour of the earthen reservoir. The flexible liquid-impervious liner can be formed from any suitable material or combination of materials which prevent the passage of liquid, e.g., water, brine (aqueous inorganic metal salt solutions such as sodium and potassium chloride solutions), etc. from the earthen reservoir to surrounding soil and are resistant to degradation from storage in soil. The liner may be fabricated from impervious materials such as rubber, e.g., nitrile rubber, polyethylene, polypropylene, polyvinyl chloride and copolymers of such materials. Combinations of other films or sheeting to provide additional strength and impermeability to the liquid stored in the reservoir may be used in combination with the aforesaid liners by, for example, bonding the materials together by techniques known in the art. When the reservoir is filled with liquid-containing waste material, e.g., drilling mud residues, to a level indicated by reference number 8, the extended sides 15*a* of liner 15 are folded over a portion of the top of the waste material leaving an open center space 9 that is not covered with extended sides 15*a* of liner 15. Open space 9 is sufficient to permit liquid forced from the reservoir by the weight of overburden soil 36** to flow out of the reservoir.

Proximate to one side of earthen reservoir 10, preferably abutting the reservoir, is in-ground drain area 20, which conveniently extends for a part of or substantially the entire length of that side of the reservoir. The drain area can, as shown, be a separate trench formed in the ground adjacent to one side of the earthen reservoir. The drain area has a near wall 22, a bottom 21 and distal wall 24. The top of near wall 22 abuts the side of the reservoir near its highest in-ground level. The bottom 21 of drain area 20 is below the top of the in-ground reservoir, i.e., lower than level 8 to which the reservoir is to be filled with liquid-containing waste material and is sloped gradually in one direcion, i.e., along its length toward standpipe 32. This allows liquid exuded from the reservoir to drain by gravity to the bottom and low end of drain area 20 where it can be removed through standpipe 32 by conventional pumping or vacuum withdrawal techniques. As shown, drain area 20 has a bottom 21, a distal side 24, and a near side 22. Drain area 20 may be constructed after drilling operations have been completed, after the reservoir has been filled and before the reservoir is encapsulated.

Drain area 20 is also lined with a flexible liquid-impervious liner 26 which generally conforms to the contour of area 20. The side of liner 26 along near wall 22 of the drain area, i.e., the side closest to earthen reservoir 10, is bonded to liner 15 of the reservoir at, for example, point 13, thereby to form an impervious liquid barrier near the junction of the reservoir and drain area. Bonding of the liners can be accomplished by any suitable technique, e.g., by the use of a suitable adhesive. Preferably, the liner reservoir and the drain area liner are of similar composition or of the same composition so that bonding of the two to form a permanent seal is not hampered by the use of incompatible liner compositions.

The reservoir and drain area liners each may be prepared from one continuous sheet if the size of the prefabricated sheet permits. Alternatively, the liners may be laid down in strip form from rolls of liner stock material, the strips overlapped and fastened together by conventional adhesive means to provide a liner of any desired size. In both cases, the sheet material inserted into the reservoir or drain area provides a continuous liquid-impervious liner.

Ballast material 30 of a relatively large or coarse size, such as railway bed ballast or crushed rock, is added to drain area 20 to provide a relatively porous bed of ballast that is sufficiently porous to allow liquid to drain readily through it. The ballast material has little, if any, fines to avoid clogging of the bed. Care should be observed to provide ballast material of a sufficiently coarse size around the bottom of hollow standpipe 32 to minimize the likelihood of clogging the bottom opening of the standpipe. Ballast material 30 is also placed on top of the extended side 15*a* of liner 15 adjacent to drain area 20. Preferably, drain area 20 is filled with ballast material to the same height as that of the adjacent ballast material present on side 15*a* of liner 15. In another embodiment, a slotted pipe (not shown), e.g., a plastic pipe, may be placed along the bottom of drain area 20 and the ballast material placed on top of the pipe. The slotted pipe may be connected at one end, e.g., the low end, directly to standpipe 32 with a plastic or rubber elbow and closed at the other end, i.e., at the elevated or higher end of the bottom of drain area 20. Alternatively, the end of the slotted pipe near to the bottom of the standpipe may be left unattached, thereby allowing fluid to accumulate around the bottom of standpipe 32.

A flexible liquid-impervious liner cap 34 is placed on top of reservoir 10 and drain area 20, i.e., over the liquid-containing waste material and ballast on the extended side 15*a* of linear 15 and ballast in drain area 20, to cover completely the top portion of the reservoir and drain area. This liner cap can be fabricated of the same material used to prepare the reservoir and drain area liners. The distal side 24 of drain area liner 26 extends over the ballast in drain area 20 and is bonded to liner cap 34 at, for example, point 27, to provide a liquid seal and prevent liquid present in the reservoir from passing into the surrounding ground areas. The distal side 24 of liner 26 may fold over liner cap 34, as shown, or under liner cap 34. Preferably, the distal side of liner 26 folds over liner cap 34. Such configuration is thought to effect a better liquid seal. Passageway 16 formed by liner cap 34, extended side 15*a* of reservoir liner 15 and ballast material 30 placed on the extended side 15*a* of liner 15 allows liquid exuded out of reservoir 10 by overburden soil 36 to pass into drain area 20. The other side of liner cap 34 may be bonded to the other ballast-free extended sides 15*a* of reservoir liner 15, typically at location 19, or, as shown, may be anchored in trench 18 by extending horizontally the liner cap for a predetermined length to conform with the contour of trench 18 and held there in position by means of overburden soil 36. Trench 18 may be used along the sides of the reservoir adjacent to the unbonded sides of the liner cap, if desired, and can be from 0.5 (15 centimeters) to 2 feet (61 scentimeters) deep relative to the top of the in-ground reservoir. The inside wall of anchor trench 18 may have a slope such that it makes an angle of from about 30° to 60°, e.g., 45° with the vertical.

In accordance with an embodiment of the present invention, an earthen reservoir having a projected 4 feet (1.2 meters) overburden is excavated and lined with a flexible liquid-impervious polyvinyl chloride membrane having extended sides. The reservoir is filled to a desired height with drilling mud residue and drill cuttings to form a liquid-containing waste material having a syrupy consistency. The extended sides of the reservoir liner are pulled partially over the top of the contents of the reservoir in a manner to leave a central portion of the liquid-containing waste exposed. A sloping drainage trench is also prepared adjacent one side of the earthen reservoir and this trench lined with a flexible polyvinyl chloride liquid-impervious liner. The side of the reservoir liner adjacent to the drainage trench and the near side of the drainage trench liner are bonded together with adhesive. The drainage trench is charged with a coarse ballast material to form a porous bed. The extended side of the reservoir liner adjacent to the drainage trench and resting atop the liquid-containing waste material is also covered with a layer of ballast material. The drain area is also provided with a standpipe during filling of the trench with ballast material. The standpipe extends from above the surface of the ground to near the bottom of the low point of the drainage trench. The entire reservoir and drain area is covered with a flexible liquid-impervious polyvinyl chloride liner cap and the cap is bonded to a horizontally extended portion of the distal side of the drain area liner, thereby to provide a liquid impermeable seal. The other sides of the polyvinyl chloride liner cap are placed into a shallow trench about 10 to about 24 inches (25–61 centimeters) deep. Thereafter, the area above the reservoir, the drain area and the anchor trench are backfilled with soil to the natural terrain and compacted firmly. Periodically, liquid present in the standpipe and (slotted pipe if used) is removed by aspirating the liquid from the surface or by installing a submersible pump in the standpipe and pumping out liquid contained therein.

The structure of the reservoir and abutting drainage trench results in an economical and effective means for catching and removing liquid that is exuded from the reservoir as a result of the weight of backfill soil placed on top of the liner cap. It is effective in preventing the passage of liquid into adjacent land areas or into subsurface aquifers, thereby preventing introduction of undesirable liquid into adjacent land areas and thence possibly into rivers and streams, which may result in pollution of those water bodies.

While the invention has been described in detail with respect to certain embodiments thereof, it is understood that the invention is not intended to be limited to such details except as and insofar as they appear in the appended claims.

We claim:

1. A method for the containment of liquid-containing waste material, comprising providing an in-ground reservoir having a bottom and defining walls opening upwardly toward the surface of the ground, providing an in-ground drain area proximate to a side of the reservoir, said drain area having a near wall adjacent to the reservoir, a sloping bottom and a distal wall, the top of the near wall and bottom of the drain area being below the top of the in-ground reservoir, installing continuous flexible liquid-impervious liners having extended sides on the bottom and against the defining walls of the reservoir and on the bottom and against the walls of the drain area, the adjacent sides of the reservoir and drain area liners being bonded together to form a liquid-impermeable seal, introducing liquid-containing waste material to the reservoir to a predetermined height, overlapping in part the waste material with the extended ends of the reservoir liner, thereby leaving a portion of the waste material uncovered, charging the drain area with ballast material, thereby to form a porous bed, and providing the drain area with a standpipe extending from near the bottom of the low end of the drain area to above the surface of the ground, covering the extended side of the reservoir liner adjacent to the drain area resting atop the waste material with ballast material, thereby providing a liquid passageway from the uncovered portion of the waste material to the drain area, covering the reservoir and drain area with a further flexible liquid-impervious liner cap, bonding together the extended distal side of the drain area liner with the adjoining liner cap to form a liquid-impermeable seal, and covering the reservoir and drain area with soil, whereby liquid exuded from the reservoir passes through the liquid passageway into the drain area.

2. The method of claim 1 wherein the unbonded sides of the liner cap are anchored by placing a horizontally extended length of the liner in a shallow trench and filling the trench with soil.

3. The method of claim 1 wherein a slotted pipe is placed along the bottom of the drain area.

4. The method of claim 3 wherein the slotted pipe is connected to the bottom of the standpipe.

5. The method of claim 1 wherein the liners are selected from the group consisting of polyvinyl chloride, polyethylene, polypropylene and rubber.

6. The method of claim 1 wherein the waste material comprises drilling residues.

7. The method of claim 1 wherein the drain area is a trench along the side of the reservoir.

8. An in-ground reservoir for containment of liquid-containing waste material comprising:

(a) an in-ground reservoir having a bottom and defining walls opening upwardly toward the surface of the ground, and having liquid waste material therein, (b) an in-ground drainage trench proximate to one side of the reservoir, said trench having a sloping bottom, a near wall adjacent to the reservoir and a distal wall, the top of the near wall of the trench abutting the adjacent reservoir wall and the bottom of the drainage trench being below the level to which the reservoir is to be filled, (c) a flexible, liquid-impervious liner having extended sides lining the bottom and walls of the reservoir, said extended sides being folded over a portion of the waste material stored in the reservoir, (d) a flexible, liquid-impervious liner lining the bottom and walls of the drainage trench, the liner on the near wall of the drainage trench being bonded to the adjacent side of the reservoir liner, said drainage trench containing a porous bed of ballast and a standpipe extending from near the bottom of the low end of the drainage pit to above the surface of the ground, (e) a porous layer of ballast atop the folded side of the reservoir liner adjacent to the drainage pit, which layer of ballast defines a liquid passageway from the reservoir to the drainage trench, whereby liquid exuded from the reservoir passes through the liquid passageway into the drainage trench, and (f) a flexible liquid-impervious liner cap extending over the entire reservoir and drainage area, the distal portion of the drainage trench liner being bonded to said liner cap.

9. The in-ground reservoir of claim 8 wherein the bottom of the drainage trench contains a slotted pipe.

10. The in-ground reservoir of claim 9 wherein the slotted pipe is connected to the bottom of the standpipe.

11. The in-ground reservoir of claim 8 wherein unbonded extended sides of the liner cap are anchored with soil in a shallow trench adjacent to the reservoir.

* * * * *